US006325243B1

(12) United States Patent
Bennett

(10) Patent No.: US 6,325,243 B1
(45) Date of Patent: Dec. 4, 2001

(54) DEVICE FOR DISPENSING CUPS

(76) Inventor: George Bennett, 1801 N. Magnolia Dr., Muncie, IN (US) 47304

( * ) Notice: Subject to any disclaimer, the term of this patent is extended or adjusted under 35 U.S.C. 154(b) by 0 days.

(21) Appl. No.: 09/710,459

(22) Filed: Nov. 10, 2000

(51) Int. Cl.[7] ..... A47F 1/04
(52) U.S. Cl. ..... 221/307; 221/310
(58) Field of Search ..... 221/64, 310, 307, 221/283

(56) References Cited

U.S. PATENT DOCUMENTS 1,131,255 * 3/1915 Luellen ..... 221/310 X
3,288,329 * 11/1966 Ketchem ..... 221/310 X
3,315,842 * 4/1967 McGurk ..... 221/310
3,365,100 * 1/1968 Piazze ..... 221/307 X
4,319,696 * 3/1982 Stevens ..... 221/310

* cited by examiner

*Primary Examiner*—David H. Bollinger
(74) *Attorney, Agent, or Firm*—E. Victor Indiano

(57) ABSTRACT

A device for dispensing cups includes a sleeve for receiving a plurality of cups. The sleeve has a first end, a second end and a generally hollow interior. A dispensing member is coupled to the sleeve, adjacent to the first end of the sleeve. The dispensing member includes a first set of cup engaging teeth and a second set of cup engaging teeth. A portal is defined in the sleeve, through which cups can be received into the hollow interior of the sleeve. The portal is closeable to form a generally axially extending, planar closed portal.

16 Claims, 3 Drawing Sheets

DEVICE FOR DISPENSING CUPS

TECHNICAL FIELD OF THE INVENTION

The present invention relates generally to a dispenser for disposable plastic cups. More specifically, the present invention relates to a disposable dispenser for disposable plastic cups that may be easily mounted by hanging.

BACKGROUND OF THE INVENTION

In the fountain drink industry, manufacturers often produce limited runs of novelty and special event cups. The manufacture of special event cups is often timed to arrive in stores in concert with a local event such as sporting events, political rallies, music festivals or other events that attract large numbers of people to the area in which it is sold. These cups are often larger than average fountain cups, and as such are unable to fit into traditional cup vending devices. Further, pitchers, which are larger than cups and possess handles are often used as special event items. Due to the inability of large and oddly shaped cups and pitchers to fit into traditional cup dispensers, the cups are often simply stacked on the floor, on counter tops, or are placed in other situations that are perceived to be unsanitary. Also, the inability to place the cups in places where cups are traditionally found leads to customer confusion and the inability of the customer to find the special event cups.

SUMMARY OF THE INVENTION

According to the present invention, a device for dispensing cups of unusual size and shape is provided. The device includes a sleeve, a dispensing member coupled to the sleeve, and a portal defined in the sleeve.

According to another embodiment of the present invention, a device for dispensing cups of unusual size and shape is provided. The device includes a flexible sleeve and a dispensing member fixedly attached to the sleeve. The sleeve is sized to serve as a reservoir for cups to be dispensed by the dispensing member. The sleeve further has a void defined therein that allows the device to be mounted.

According to yet another embodiment of the present invention, a device for housing and dispensing cups of unusual size and shape is provided. The device includes a plastic sleeve that is a plastic tube and has a flat portion where the walls of the sleeve are fixed together. The device also includes a void defined in the flat portion of the plastic sleeve and a plastic dispensing member that fixedly seals an end of the plastic sleeve. The device further includes a void defined in the dispensing member wherein teeth protrude into the void from the dispensing member. The device also includes a portal defined by the end of the plastic sleeve opposite the end sealed to the dispensing member.

Additional features of the disclosure will become apparent to those skilled in the art upon consideration of the following detailed description when taken in conjunction with the accompanying drawings.

DETAILED DESCRIPTION OF THE DRAWINGS

Figure 1:
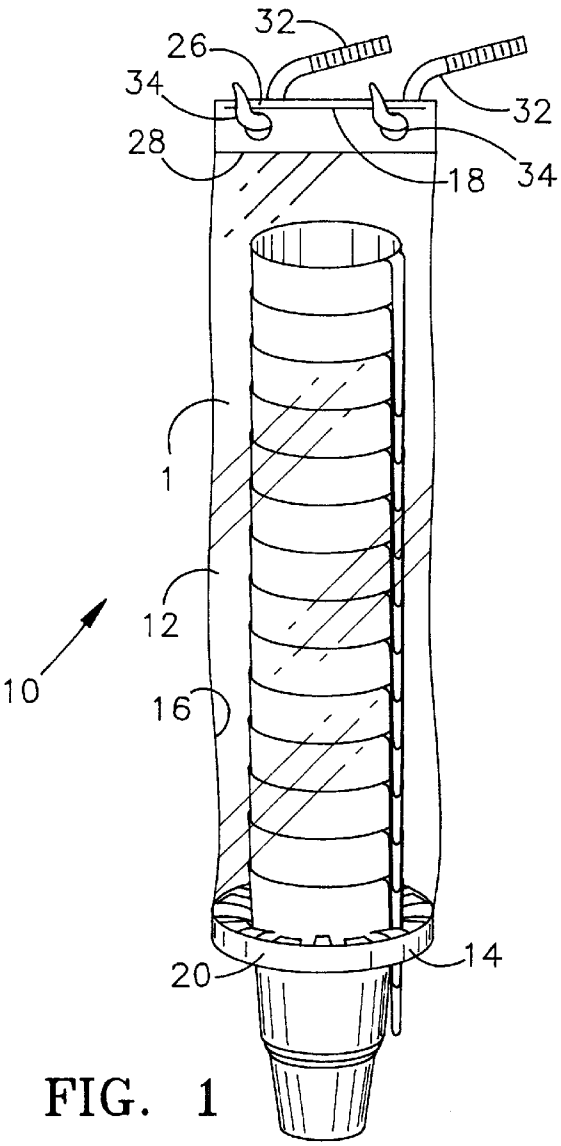
FIG. 1 is a perspective view of a cup dispenser incorporating the present invention therein.

Referring now to the drawings, FIG. 1 shows a cup dispenser 10 including a cup reservoir 12, a dispensing member 14, and reinforcing strips 18. The cup 44 reservoir 12 is an elongated tube formed of flexible thin plastic. By the nature of being a tube, the cup reservoir 12 has a hollow interior, void 16 defined therein. The dispensing member 14 is constructed of polypropylene, a more rigid plastic than that of the reservoir 12, and comprises a generally circular ring. The reservoir is preferably about 2 feet in length. However, other lengths are envisioned to provide reservoirs of decreased or increased capacity, as desired.

Figure 5:
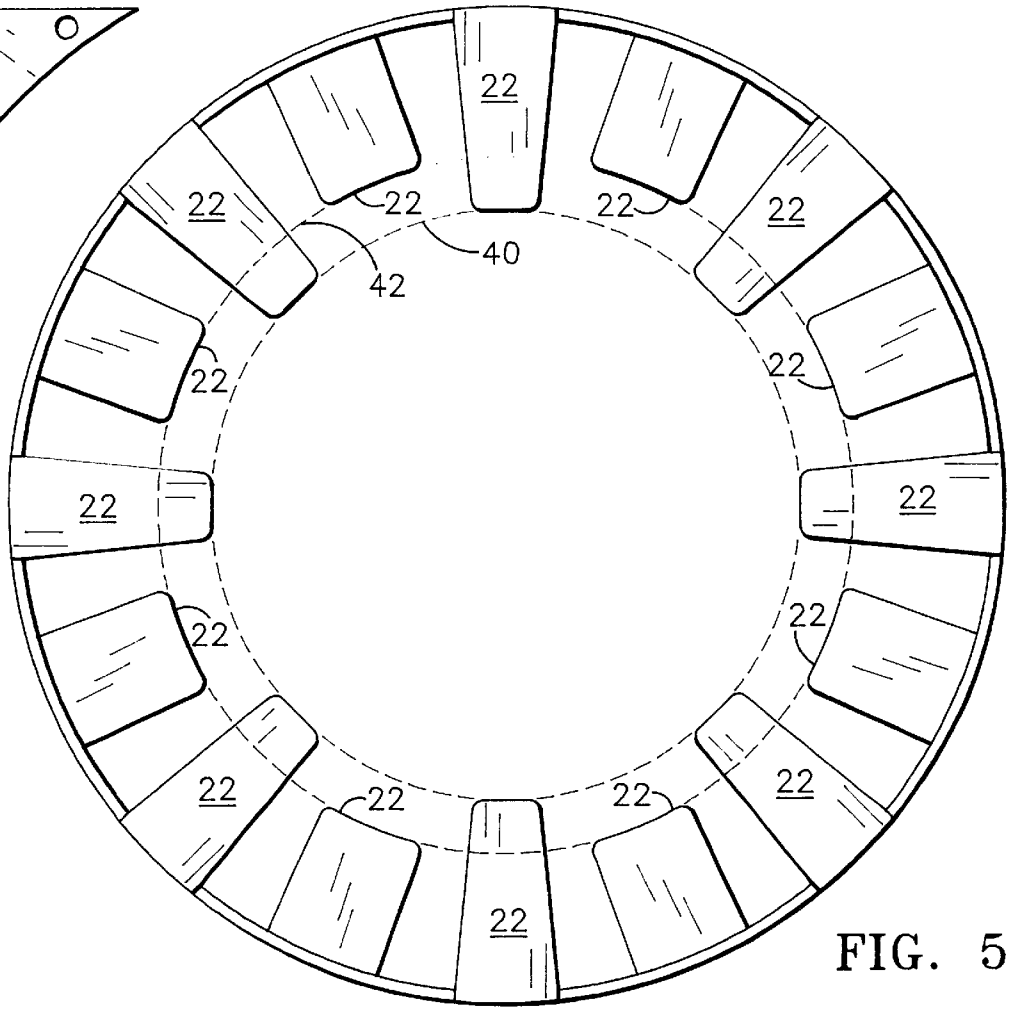
FIG. 5 is a top view of the dispenser shown in FIG. 1.

The dispensing member 14 is preferably about 6 inches in diameter and the outer circumference of the dispensing member 14 has an axial length of preferably about one inch, to comprise a one inch tall band 20. Two sets of teeth, an upper set of teeth 22 and a lower set of teeth 24 extend radially inwardly from the band 20 towards the center of the circle defined by the band 20. In one embodiment, the lower set 24 of teeth comprise a set of eight teeth disposed in an evenly spaced array along the band 20. The lower set 24 is placed to be joined to the band 20 at the lower edge of the band 20. Each tooth is approximately 9/16" wide at the tooth base (where it contacts the band 20), 3/8" wide at its radially inner end, and 1.5 inches in its length, measured in a radial direction. The upper set 22 of teeth is disposed about 0.25 inches axially inwardly on the band 20 and also comprises eight radially inwardly extending teeth. The eight teeth of the upper set 22 are spaced in an even array and axially offset from the teeth of the lower set 24 as shown in FIG. 5. In one embodiment, the teeth of the upper set 22 are about 13/16" long (measured in a radial direction), 0.75 inches wide at their base, and 9/16" wide at their radially innermost end. However, it should be appreciated that the dimensions of both sets of teeth can be altered to allow the dispenser 10 to be used with cups 44 of different sizes. Further, one or more of the teeth may be removed to allow cups 44 with radially outwardly extending handles, such as the pitchers 27, having handles 29, shown in FIGS. 1 and 2, and the like to fit through the dispensing member 14. The outside of the band 20 of the dispensing member 14 is sealed to a radially inwardly facing axial surface at an end of the reservoir 12.

The reservoir 12 is sized so as to have a circumference slightly larger than the circumference of the dispensing member 14. The dispensing member 14 is interiorly received within the void 16 of the reservoir 12 to mate snugly with the radially inwardly facing surface of the walls of the reservoir 12 such that the lower end of the dispensing member 14 is positioned axially evenly with the end of the reservoir 12. The dispensing member 14 is then fixed to the reservoir 12. The fixation is preferably effectuated through the application of heat to the plastic wall of the reservoir 12 at a point where it overlaps the dispensing member 14. Heat is applied to heat sealingly bond the two plastics without burning through either plastic member. It should be appreciated that other methods of fixing the reservoir 12 to the dispensing member 14 such as adhesives and stapes could also be used.

While one end of the reservoir 12 is now filled by the dispensing member 14, the opposite end currently remains open. The opposite end is a portal 26 through which cups 44 may be loaded into the reservoir 12. The plastic at the portal end of the reservoir 12 is reinforced, preferably with reinforcing strips 18 constructed of a thicker and/or more rigid plastic than that of the reservoir 12.

The plastic of the reservoir 12 is folded back upon itself to form a pocket 28. The reinforcing strips 18 are placed in the pocket 28, and the pocket is then sealed, preferably by the application of heat to the plastic.

When the reinforcing strips 18 are sealed in the pocket 28, the reinforcing strips 18 are generally planar when in a rest position, meaning, that no outside force is acting on them to deform them. Preferably, each reinforcing strip has a length approximately 0.25 inches shorter than half the circumferences of the reservoir 12. The rest position allows the reinforcing strips 18 to remain generally planar, and causes the reservoir to flatten at the portal end 26. A hole 34 or plurality of holes 34 may then be cut in the walls of the reservoir at the portal end 26, near or through the reinforcing strips 18. If placed near the reinforcing strips 18, the holes should be disposed nearer the dispensing member 14, thereby being disposed axially outwardly of the strips 18, so that the strips 18 can be used to help carry the weight of the filled dispenser 10. Hooks 32 may be placed within the holes 34 as a means for vertically mounting the dispenser 10.

Figure 2:
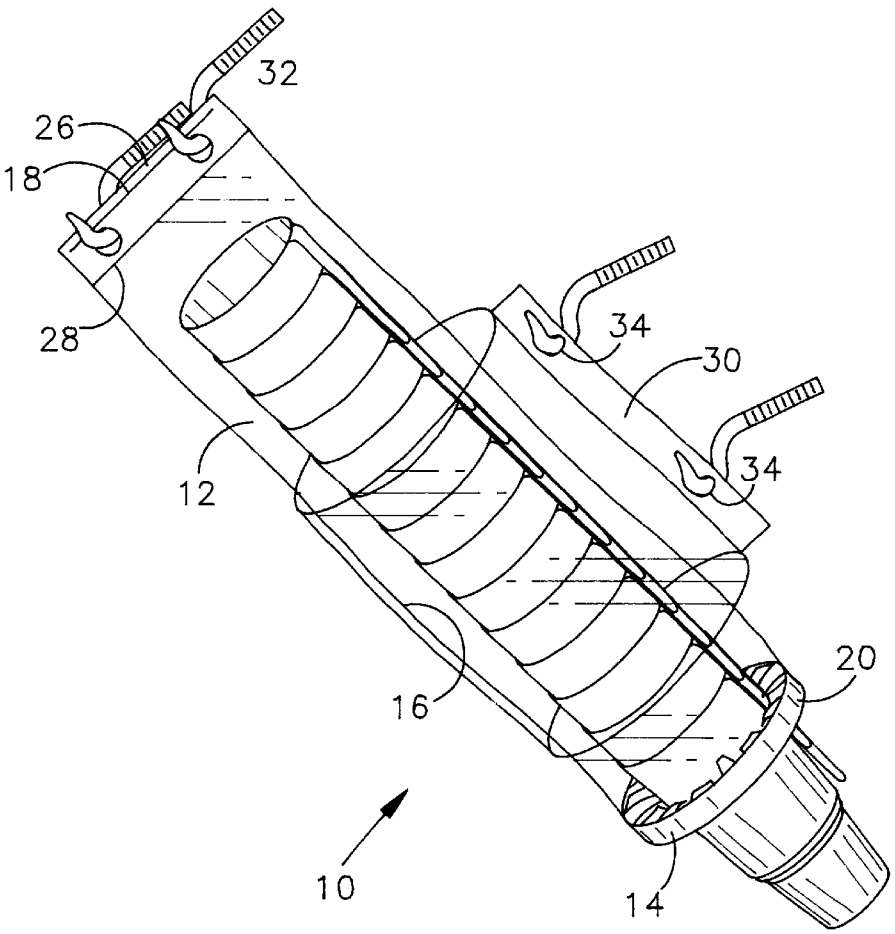
FIG. 2 is a perspective view of the dispenser of FIG. 1 mounted at an angle.

As an alternative to vertical mounting, it may be desirable to mount the dispenser 10 horizontally or at an angle, wherein the dispensing member 14 is disposed at a lower elevation than the portal end 26. To this end, the wall of the reservoir may be heat sealed to itself along a side of the reservoir 12 as seen in FIG. 1. Holes 34 may then be cut through the sealed side section of the reservoir 12. Hooks 32 may be inserted into the holes 34 to engage the reservoir 12, to thereby allow the dispenser 10 to be mounted horizontally or at an angle, as seen in FIG. 2. Reinforcing strips 18 may be placed within the sealed side portion of the reservoir 12 if desired, to help prevent the walls of the reservoir 12 from tearing under the stress imposed on the dispenser 12. As an alternative to sealing a side portion of the reservoir, a larger sleeve with holes formed therein that are sized to receive hooks 32 may be placed around the reservoir. The sleeve may either be fixedly attached to the reservoir, if the manufacturer desires to fix the position of the sleeve vis-a-vis the reservoir, or may be sized to slidably receive the reservoir, to thereby make the axial position of the sleeve adjustably positionable with respect to the reservoir.

Figure 4:
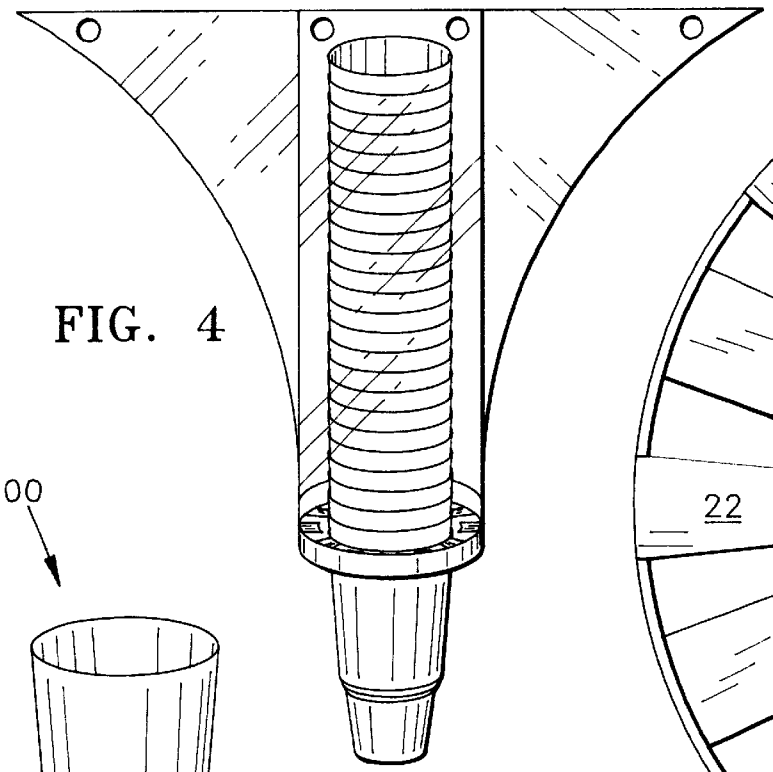
FIG. 4 is a perspective view of the dispenser of FIG. 1 with added appendages to facilitate the display of an advertisement.

FIG. 4 shows the dispenser with banner-like appendages 36 added to the sides of the reservoir 12. The appendages 36 allow an advertisement to be placed on the plastic that is larger, and hence more likely to get noticed than an advertisement small enough to fit on the reservoir 12 alone.

Figure 3:
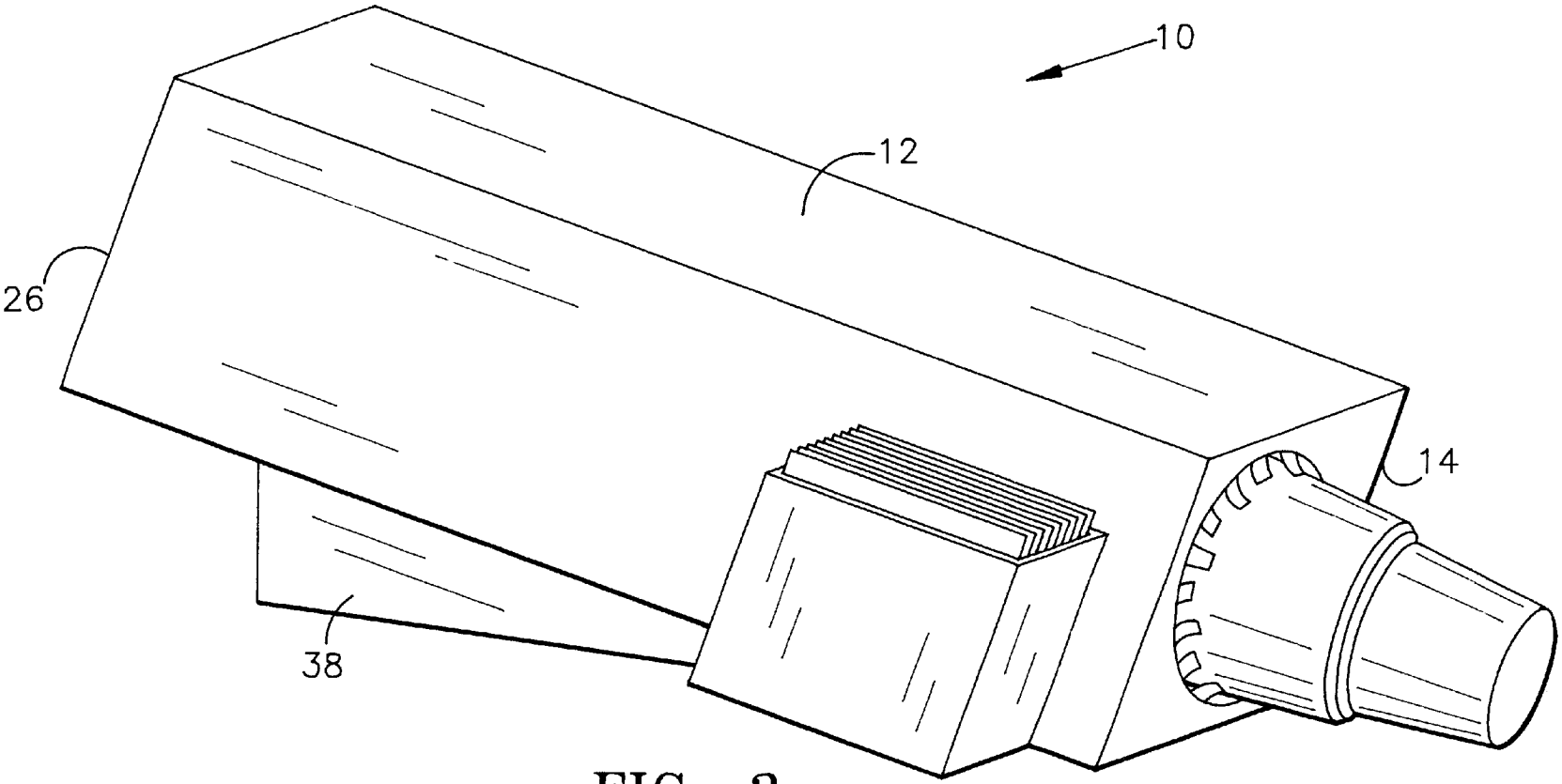
FIG. 3 is a perspective view of the dispenser of FIG. 1 with a box-type cup reservoir.

While the dispenser 10 has heretofore been described as having a flexible plastic and bag-like reservoir 12, it should be appreciated that the dispensing member 14 may be used in conjunction with a reservoir 12 that has more rigid walls. FIG. 3 shows an embodiment where the dispensing member 14 is configured to receive cups 44 with handles, and is affixed to a reservoir 12 constructed of a more rigid plastic such as polypropylene. The reservoir 12 further has a support leg 38 attached to the bottom of the reservoir 12 for placing the reservoir 12 at an angle with respect to the surface upon which the dispenser 10 rests.

The angle places the cup dispensing end of the reservoir 12, i.e. that end to which is attached the dispensing member 14 near the horizontally disposed surface upon which the dispenser 10 sits. Also, the angle cup receiving end of the reservoir 12 (i.e. that end which has the portal 26) in a raised position above the surface upon which the dispenser 10 sits. Under the influence of gravity, this angle urges the cups 44 within the reservoir 12 to protrude in an axially outward direction, so that the bottom of the lower-most cup within the dispenser protrudes outwardly from the dispensing member 14. Whereas the plastic "bag-type" dispenser 10 had the reinforcing strips 18 and hooks 32 to keep the portal 26 closed, the present embodiment of the portal 26 takes the form of a door that may be opened to insert cups 44, and then closed when put in use. The door at portal 26 may be either a removable door having an axially extending perimeteral lip for engaging the wall of the reservoir 12, or can be formed as a flap that is hingedly coupled to the reservoir 12 by a living hinge.

Figure 6:
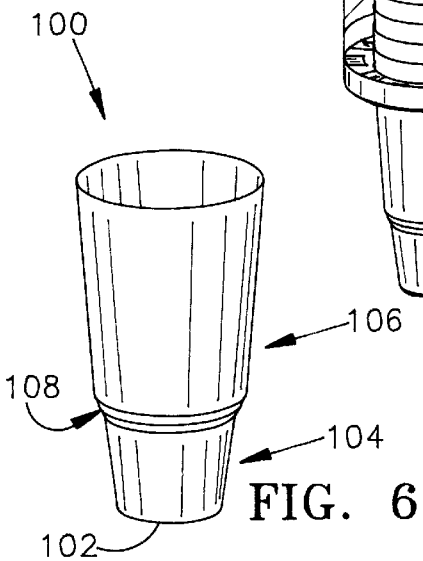
FIG. 6 is a side plan view of a cup of the type which is particularly well suited for dispensing by the dispenser of the present invention.

In operation, the dispenser 10 is used to display and offer for sale cups 44 to be used for fountain drinks. Typically, injection molded plastic cups 44 and thermo-formed cups 44 are used in the dispenser 10. These cups 44 are usually wider at the mouth of the cup 44 than at the base of the cup. One type of cup which is particularly well suited for use with the present invention is a "two stage" jumbo cup of the type manufactured by Berry Plastics of Evansville, Ind., which is shown in FIG. 6. The two stage cup 100 has a generally two stage, frusto-conical shape, with a generally planar, or slightly concave disc-shaped bottom surface 102, a relatively smaller diameter, frusto-conically shaped lower portion 104, and a relatively larger diameter, frusto-conically shaped upper portion 106. A generally radially extending step 108 provides a transition between the lower portion 104 and the upper portion.

The cup 100 is formed as a two stage cup so that the lower portion 104 can be received and held securely by a standard automotive cup holder, while the larger diameter of the upper portion provided for increased cup capacity, when compared to a standard one stage cup. Sufficient cups 44 for filling the dispenser 10 are placed into the reservoir 12 through the portal 26. The dispenser 10 is typically held by hooks that engage the portal 26 end of the reservoir 12 such that the dispensing member 14 and reservoir 12 hang below the portal end 26.

The cups 44 are inserted through the portal 26 with the cup 44 oriented such that the base of the cup 44 is disposed beneath the open mouth of the cup, so that the base is disposed closer to the floor of the establishment and the mouth of the cup 44 opens upwardly toward the ceiling. The cups 44 will then slide downward within the hollow interior void 16 and nest within other cups 44. The first (bottom most) cup 44 that is inserted into the void 16 will slide down within the reservoir 12 and engage the dispensing member 14. When cups such as cup 100 are used, the teeth of the dispensing member are configured to grab the cup either on the step 108 or on the radially outwardly facing surface of the upper portion 106.

The cup 44 will enter the hollow void 40 that is created by and defined by the band 20 and the sets of teeth 22, 24. The cup 44 will continue to move downward until the cup 44 reaches a position where the radially outwardly facing surface of the cup 44 engages the radially inwardly facing surfaces of the teeth 22, 24. The cup 44 will engage the teeth 22, 24 when the cup 44 has moved down far enough such that the diameter of the cup 44 at the plane that the cup 44 engages the teeth is equal to the diameter of the void 40 defined by the teeth.

The teeth 22, 24 are designed to be deformable and thereby to flex somewhat, especially at their radially inwardmost position. Flexure of the teeth 22, 24 will result in an increase in the larger diameter of the void 40 to allow the cup 44 to seat lower in the dispensing member 14. Further, as the cups 44 seat within each other and the number of cups 44 in the reservoir 12 increases, the weight bearing on the teeth 22, 24 of the dispensing member 14 will increase, thereby causing the teeth 22, 24 to flex a greater amount. The teeth 22, 24 are designed to be crafted from a plastic such that when the reservoir 12 is full of cups 44, the teeth will not flex far enough to allow an aperture (void 40) which is of a diameter greater than the largest diameter (usually at the mouth) of the cups 44. This parameter ensures that the dispensing member 14 can maintain the cups 44 in the reservoir 12 when the reservoir 12 is full and vertical such that the entire weight of the cups 44 bears on the teeth.

When a customer desires to use a cup, the customer grasps the base portion of the cup 44 that is protruding axially outwardly from the dispensing member 14. As stated above, the base portion protrudes from the dispensing member 14 because the base portion has a smaller diameter than the aperture (void 40) defined by the sets of teeth 22, 24. After the customer grasps the base portion of the cup, the customer pulls the cup 44 axially outwardly away from the dispensing member 14. By increasing the force upon the cup, the sets of teeth 22, 24 are biased to increase their degree of flexure.

The lower set 24 of teeth are longer, and thereby extend radially inwardly further than the upper set 22 of teeth. As the teeth are flexed further by the added force of the customer pulling on the cup 44, the upper set 22 of teeth define an aperture (void 42) having a larger diameter than does the lower set of teeth 24. Therefore, as the teeth are flexed, there will be a point where the lower set 24 engages the cup, but the upper set 22 is deformed sufficiently radially outwardly to allow the cup 44 to pass through the void 42 defined thereby. At this point, the upper set 22 engages the cup 44 nested inside the grasped cup 44 and retains said second cup 44 within the reservoir 12. The customer then continues to pull on the grasped cup 44 until pressure causes the void 40 defined by the lower set 24 of teeth to become larger than the diameter of the largest point on the grasped cup 44 (usually the top of the mouth of the cup 44) and release the grasped cup 44 to the customer. The lower set 24 of teeth will then spring back so that the distal (radially inward) ends of the teeth of the lower set 24 move radially inwardly to engage the next cup 44 in the reservoir that the upper set 22 of teeth has already retained. At this point, the next cup 44 is now protruding from the dispensing member 14 and is ready to be grasped by a customer.

What is claimed is:

1. A device for dispensing cups comprising:

a sleeve comprising a generally tubular bag constructed of a flexible plastic material for receiving a plurality of cups, the sleeve having a first end, a second end and a generally hollow interior, a dispensing member coupled to said sleeve, adjacent the first end of the sleeve the dispensing member including a first set of cup engaging teeth and a second set of cup engaging teeth; and a portal defined adjacent to the second end of the sleeve, through which cups can be received into the hollow interior of the sleeve said portal being closeable to form a generally axially extending, planar closed portal.

2. The dispenser of claim 1, wherein said dispensing member comprises a ring defining a dispensing aperture into which the first and second set of engaging teeth extend, the dispensing aperture being sized to permit a cup to pass therethrough.

3. The dispenser of claim 2, wherein said first and second set of teeth comprise a first and second set of deformable teeth, the first and second set of deformable teeth having sufficient rigidity to maintain a plurality of cups within the sleeve wherein only the force of gravity is acting upon the cups.

4. The dispenser of claim 3, wherein the first and second set of teeth are sufficiently deformable to permit a cup to deform under the influence of a manually pulling force to permit a cup to pass through the dispensing aperture to be removed from the sleeve.

5. The dispenser of claim 1, wherein said portal is disposed adjacent to the second end of the sleeve.

6. The dispenser of claim 1, wherein said portal which when sealed, creates a seal strong enough to prevent cups from exiting the sleeve through the portal, when the second end if the sleeve is held below the first end of the sleeve.

7. A device for dispensing cups comprising:

a sleeve for receiving a plurality of cups, the sleeve having a first end, a second end and a generally hollow interior, a dispensing member coupled to said sleeve adjacent the first end of the sleeve, the dispensing member including a first set of cup engaging teeth and a second set of cup engaging teeth; and a portal defined in said sleeve, through which cups can be received into the hollow interior of the sleeve, further comprising a mounting member for permitting the dispenser to be mounted to a generally vertically disposed planar surface, the mounting member including a hook having an attaching portion for attaching to the mounted surface, and a hook portion; and the sleeve includes a hook receiving aperture.

8. The dispenser of claim 7, wherein the sleeve includes at least one reinforcing member disposed adjacent the portal and the hook receiving apertures; the reinforcing member being positioned to absorb the force exerted by the hook on the hook receiving aperture for reducing the likelihood of the sleeve tearing upon the application of a manually pulling force on a cup contained within the sleeve.

9. A device for dispensing drinking cups comprising; a flexible sleeve for receiving a plurality of cups, the sleeve having a first end, a second end and generally hollow interior, and a dispensing member fixedly attached to said sleeve adjacent the first end of the sleeve, the dispensing member including a firsts set of cup-engaging teeth and a second set of cup-engaging teeth;

said sleeve being sized to serve as a reservoir for cups to be dispensed by said dispensing member, said sleeve having a mounting portion disposed at the second end thereof and at least one reinforcing member disposed adjacent the mounting portion, the reinforcing member being positioned adjacent the mounting portion for reducing the likelihood of the sleeve tearing upon the application of a pulling force on a cup contained within the sleeve.

10. The dispenser of claim 9, wherein said sleeve is a bag constructed of flexible plastic.

11. The dispenser of claim 9, wherein said dispensing member comprises a ring defining a dispensing aperture into which the first and second engaging teeth extend, the dispensing aperture being sized to permit a cup to pass therethrough, upon deformation of the teeth.

12. The dispenser of claim 11, wherein said first and second set of teeth comprise a first and second set of deformable teeth, the first and second set of deformable teeth having sufficient rigidity to maintain a plurality of cups within the sleeve when only the force of gravity is acting upon the cups, and sufficient flexibility to deform sufficiently to permit a cup to pass therethrough under the influence of a manually exerted pulling force.

13. The dispenser of claim 9, further comprising:

a portal located at the second end of said sleeve.

14. A device for dispensing drinking cups comprising:

a flexible sleeve for receiving a plurality of cups, the sleeve having a first end, a second end and generally hollow interior, and a dispensing member fixedly attached to said sleeve adjacent the first end of the sleeve, the dispensing member including a first set of cup-engaging teeth and a second set of cup-engaging teeth; said dispensing member comprising a ring defining a dispensing aperture into which the first and second engaging teeth extend, the dispensing aperture being sized to permit a cup to pass therethrough, upon deformation of the teeth, said sleeve being sized to serve as a reservoir for cups to be dispensed by said dispensing member, and said sleeve having a mounting portion by which the device may be mounted, wherein said void is sized so as to allow a cup with a handle to pass therethrough.

15. A cup dispenser for dispensing cups having a base, a relatively smaller diameter lower portion disposed adjacent to the base, a relatively greater diameter upper portion and a generally radially extending step portion disposed between the lower portion and the upper portion, the cup dispenser comprising a flexible plastic sleeve deformable between a generally planar storage configuration and a generally cylindrical cup containing configuration; the sleeve including a generally hollow interior when in the cup containing configuration, a first end and a second end, the second end defining a portal through which cups can be received into the generally hollow interior, a ring-shaped dispensing member disposed adjacent to and fixedly engaged to the second end of the sleeve, the dispensing member including a ring portion having an axially extending, radially outwardly facing surface fixedly attached to the sleeve and an axially extending, radially inwardly facing surface, a first set of deformable cup engaging teeth fixedly attached to and extending radially inwardly from the radially inwardly facing surface of the dispensing member, a second set of deformable cup engaging teeth fixedly attached to and extending radially inwardly from the radially inwardly facing surface of the dispensing member, the second set of teeth being axially offset from the first set of teeth, and having a radial dimension different from the first set of teeth, a reinforcing member disposed adjacent the second end of the sleeve for resisting tearing of the sleeve; and an attaching portion disposed adjacent the reinforcing member for receiving an attaching member for attaching the sleeve to a generally vertically disposed surface.

16. The device of claim 15 wherein, the attaching member comprises at least one hook, and the attaching portion comprises at least one hook receiving aperture, and the reinforcing member is positioned to absorb the force exerted by the hook on the hook receiving aperture for reducing the likelihood of the sleeve being torn upon the exertion of the removal of a cup from the dispenser.

* * * * *